US006112042A

United States Patent [19]

Imamura et al.

[11] Patent Number: 6,112,042

[45] **Date of Patent: *Aug. 29, 2000**

[54] DEVELOPING DEVICE AND DEVELOPING ROLLER THEREFOR

[75] Inventors: Tsuyoshi Imamura; Makoto Nakamura; Kyota Koetuka; Kenji Narita; Kenichi Ishiguro, all of Kanagawa, Japan

[73] Assignee: Ricoh Company, Ltd., Tokyo, Japan

[ * ] Notice: This patent is subject to a terminal disclaimer.

[21] Appl. No.: 09/432,212

[22] Filed: Nov. 3, 1999

Related U.S. Application Data

[63] Continuation of application No. 09/160,591, Aug. 25, 1998, Pat. No. 6,070,038.

[30] Foreign Application Priority Data

Sep. 26, 1997 [JP] Japan ..... 9-279712
Sep. 1, 1998 [JP] Japan ..... 10-262416

[51] Int. Cl.[7] ..... G03G 15/09

[52] U.S. Cl. ..... 399/277; 148/103; 264/DIG. 58

[58] Field of Search ..... 399/275, 277; 335/302, 306; 492/8; 29/607, 608; 148/103; 264/DIG. 58

[56] References Cited

U.S. PATENT DOCUMENTS 5,970,294 10/1999 Narita et al. ..... 399/286

FOREIGN PATENT DOCUMENTS 5-121257 5/1993 Japan .

*Primary Examiner*—Joan Pendegrass
*Attorney, Agent, or Firm*—Oblon, Spivak, McClelland, Maier & Neustadt, P.C.

[57] ABSTRACT

A developing roller is made up of a magnet member and a sleeve surrounding the magnet member. A sophisticated magnetic characteristic including a repulsive pole can be easily formed on the surface of the sleeve. The repulsive pole causes a developer to be sharply released from the surface of the sleeve. A developing device including the developing roller is also disclosed.

5 Claims, 7 Drawing Sheets

DEVELOPING DEVICE AND DEVELOPING ROLLER THEREFOR

This application is a Continuation of application Ser. No. 09/160,591 filed on Aug. 25, 1998 now U.S. Pat. No. 6,070,038.

BACKGROUND OF THE INVENTION

The present invention relates to a developing device included in a copier, facsimile apparatus, laser printer or similar electrophotographic image forming apparatus and a developing roller therefor.

Generally, a developing device included in an image forming apparatus of the kind described includes a developing roller, i.e., a magnet structure body having a magnet member fixed in place within a rotatable sleeve. The sleeve conveys a developer deposited thereon. Specifically, the developing roller is constituted by a metallic core, a plastic magnet or similar magnet member formed with a plurality of fixed magnetic poles, a rotatable sleeve formed of aluminum or similar nonmagnetic material, a drive flange, and a driven flange. When the developing roller is expected to operate with a magnetic carrier and nonmagnetic toner mixture, i.e., a two-ingredient type developer, it must be provided with a desired magnetic characteristic or flux density pattern.

A predominant procedure for producing the above magnet member molds a plastic magnet, rubber magnet or similar magnetic material by extrusion molding or injection molding while applying magnetic fields to the material (multipole orientation). The magnet member is, in many cases, implemented as a roll for the purpose of simplifying steps to follow the molding and enhancing efficient production. The roll type magnet member is a tubular resin body (referred to as a molding hereinafter). The molding may be produced by feeding resin containing a magnetic substance from an extruder to an orienting die in a tubular configuration and then applying magnetic fields for anisotropism (orientation).

In practice, the structure with the core and magnet member covering the core is produces by molding the core and magnet member integrally or by inserting the core into the magnet member implemented as a pipe beforehand. The former scheme is rarely used because it is difficult to guarantee the angles of magnetic poles. The latter scheme forms a flat surface between magnetic poles and inserts the core by using the flat surface as a reference, as taught in Japanese Patent Laid-Open Publication No. 63-289908 by way of example. In any case, the problem with the conventional procedures is that it is difficult to provide the surface of the sleeve with a sophisticated magnetic characteristic including a repulsive magnetic pole.

SUMMARY OF THE INVENTION

It is therefore an object of the present invention to provide a developing roller allowing the surface of a sleeve accommodating a magnet member to be easily provided with a sophisticated magnetic characteristic including a repulsive magnetic pole, and a developing device including the same.

In accordance with the present invention, a developing roller includes a rotatable sleeve. A magnet member is disposed in the sleeve and has a plurality of magnetic poles including a releasing pole for generating an the surface of the sleeve a magnetic force for releasing a developer containing magnetic particles from the surface. The magnetic member has on a part of its outer periphery a reference portion spaced from the surface of the sleeve by a distance greater than portions adjoining the reference portion at the upstream side and downstream side in the direction of rotation of the sleeve, and extends in the direction perpendicular to the direction of movement of the surface of the sleeve. The releasing pole is magnetized in the reference portion.

Also, in accordance with the present invention, a developing device includes a developing roller having a rotatable sleeve and a magnet member disposed in the sleeve and having a plurality of magnetic poles including a releasing pole for generating on the surface of the sleeve a magnetic force for releasing a magnetic agent from said the. A casing member accommodates the developing roller. The sleeve is rotatably received in the casing member. The magnet member is fixed in place in the sleeve so as not to move relative to the casing member. The casing member is formed with an opening aligning with the main pole of the magnet member. A releasing portion adjoining the releasing pole for causing a part of the magnetic agent to be released from the surface of the sleeve and a storing portion communicated to the releasing portion for storing the magnetic agent are defined in the casing member.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 1:
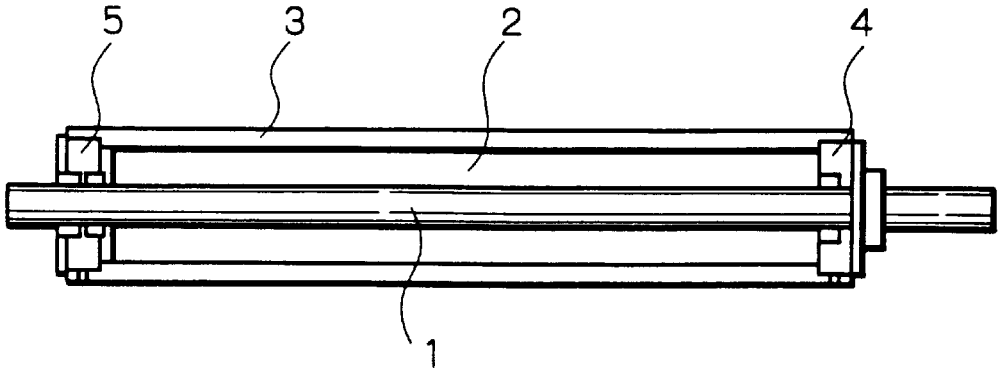
Fig. 1 PRIOR ART
FIG. 1 is a vertical section showing a conventional developing roller operable with a two-ingredient type developer.

To better understand the present invention, brief reference will be made to a conventional developing roller, shown in FIG. 1. As shown, the developing roller is generally made up of a metallic core 1, a plastic magnet or similar magnet member 2 formed with a plurality of fixed magnetic poles, a rotatable sleeve 3 formed of aluminum or similar nonmagnetic material, a drive flange 4, and a driven flange 5. The drive flange 4 is mounted on one end of the sleeve 3 for transferring the rotation of a drive mechanism, not shown, to the sleeve 3. The driven flange 5 is mounted on the other end of the sleeve 3 for retaining the magnet member 2 in the sleeve 3.

Assume that the developing roller is operable with a developer consisting of nonmagnetic toner and magnetic carrier. Then, the developing roller must be provide with a magnetic characteristic, i.e., a flux density pattern shown in FIG. 2 specifically. The fixed magnetic poles of the magnet member 2 each forms a particular magnetic pole on the outer periphery of the sleeve 3. This, coupled with the rotation of the sleeve 3, conveys the developer at magnetic poles P2, P3 and P6 having high flux densities. At a magnetic pole P1, the developer is transferred from the sleeve 3 to a latent image electrostatically formed on an image carrier not shown. At a magnetic pole P5, the developer is drawn up onto the sleeve 3. Further, at a magnetic pole P4 having a low flux density, the developer is released from the sleeve 3 every time the sleeve 3 completes one rotation.

Figure 3:
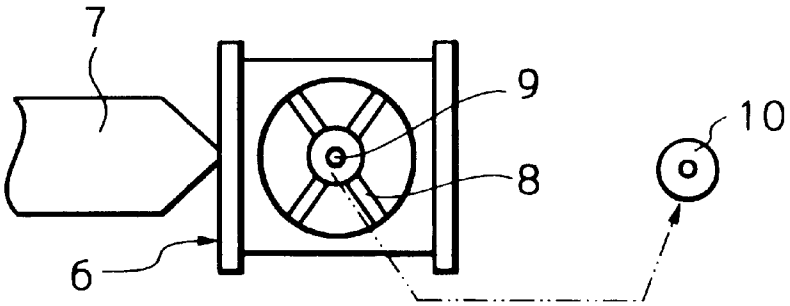
Fig. 3 PRIOR ART
FIG. 3 is a section showing an injection molding machine applicable to the conventional developing roller.
Figure 4B:
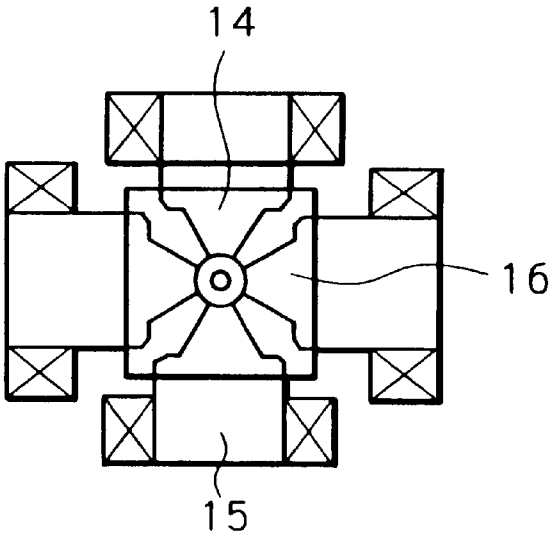
Fig. 4B PRIOR ART
FIG. 4B is a horizontal section of the machine shown in FIG. 4A.
Figure 4A:
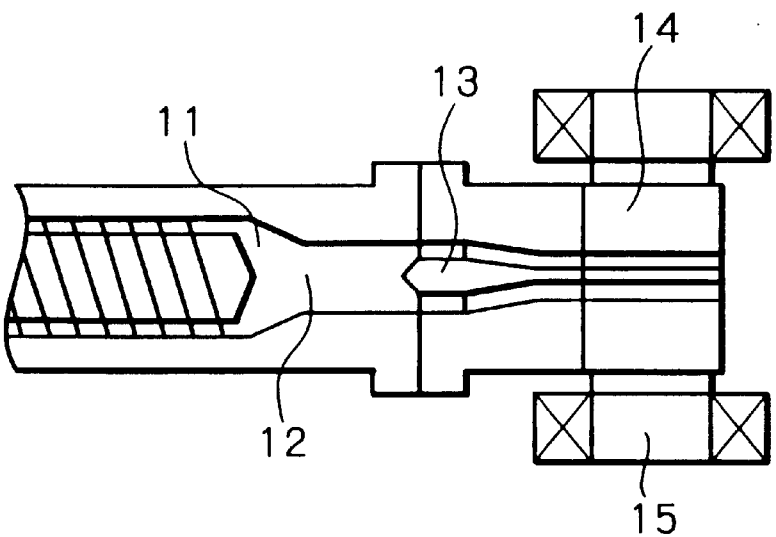
Fig. 4A PRIOR ART
FIG. 4A is a vertical section showing an extrusion molding machine also applicable to the conventional developing roller.

FIG. 3 shows an injection molding machine which may be used to produce the magnet member 2 included in the conventional developing roller. As shown, the machine includes a mold 6, a cylinder 7, yokes (permanent magnets or electromagnets) 8 serving as a magnetic field orientation die, a shaft 9, and a molding or product 10. FIGS. 4A and 4B show an extrusion molding machine which may alternatively be used to produce the magnet member 2. As shown in FIGS. 4A and 4B, resin is fed to a die 14 via a cylinder 12 and a nipple 13 by a screw 11. The die 14 implements magnetic field orientation. Subsequently, a coil 15 applies a magnetic field so as to execute anisotropism (orientation) with the resin while extruding it. A take-off, not shown, driven at a constant speed takes off the resin being extruded. The reference numeral 16 designates yokes.

In practice, the structure with the core 1 and magnet member 2 covering the core 1, as shown in FIG. 1, is produced by molding the core 1 and magnet member 2 integrally or by inserting the core 1 into the magnet member 2 implemented as a pipe beforehand. In any case, the problem with the conventional procedure is that it is difficult to provide the surface of the sleeve 3 with a sophisticated magnetic characteristic shown in FIG. 2 including the repulsive magnetic pole P4.

A preferred embodiment of the present invention will be described hereinafter which is applied to the production of a magnetic member disposed in a developing roller. The developing roller is a magnet body applicable to an image forming apparatus. The illustrative embodiment will also be described in relation to the extrusion molding machine shown in FIGS. 4A and 4B, so that identical structural elements are designated by identical reference numerals.

Figure 5A:
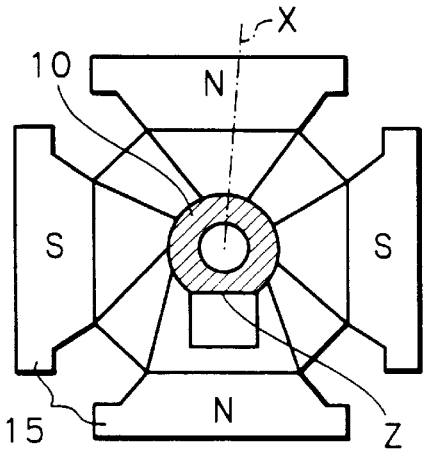
FIG. 5A is a horizontal section showing an extrusion molding machine applicable to a magnet member included in a developing roller embodying the present invention.
Figure 5B:
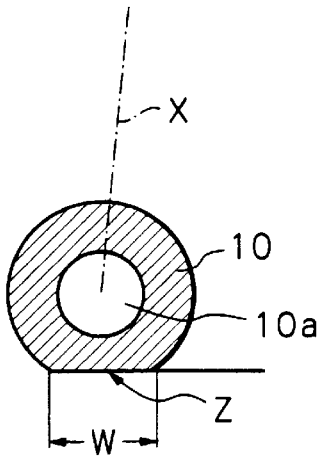
FIG. 5B is a section showing a molding produced by the machine of FIG. 5A.

Referring to FIGS. 5A and 5B, there is shown the general construction of an extrusion molding machine for producing the magnet member of the illustrative embodiment. For the magnetic member, use is made of a plastic magnet material, rubber magnet material or similar resin. First, the resin is subjected to magnetic field orientation by the magnetic fields of an orientation die 14. At the same time, the resin is molded in a configuration complementary to the die 14, i.e., provided with a circumference including a flat reference surface Z having a preselected angle relative to an orienting position X. Let the molded magnet member be referred to as a molding 10 hereinafter. At this instant, the reference surface Z is spaced by a preselected distance from the orienting position X. Subsequently, the molding 10 is demagnetized either continuously during molding or after being cut into pieces each having a preselected length.

Figure 6A:
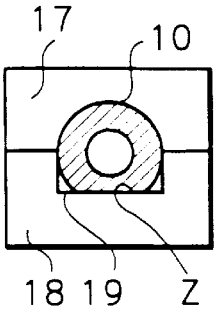
FIG. 6A is a section showing the molding of FIG. 5B held by presser members for the insertion of a metallic core.
Figure 6B:
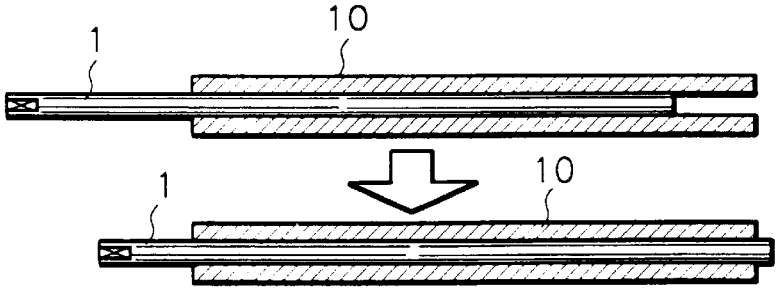
FIG. 6B shows how the core is inserted into the molding of FIG. 6A.

As shown in FIG. 6A, the demagnetized molding 10 is sandwiched between a pair of presser members 17 and 18 such that the reference surface Z and the reference surface, not shown, of the core 1 will have a preselected angle relative to each other. Then, the core 1 is inserted into an axial bore 10*a* extending throughout the molding 10. A pressing surface 19 is formed in the inner periphery of the presser member 18 and closely contacts the reference surface Z of the molding 10. In this condition, the reference surface of the core 1 and the orienting position X of the molding 10 can be matched to the positions of magnetic poles required of a product. For the insertion of the core 1, adhesive may be applied to the inner periphery of the molding 10 or the outer periphery of the core 1, or the core 1 may be press-fitted in the molding 10.

Figure 7A:
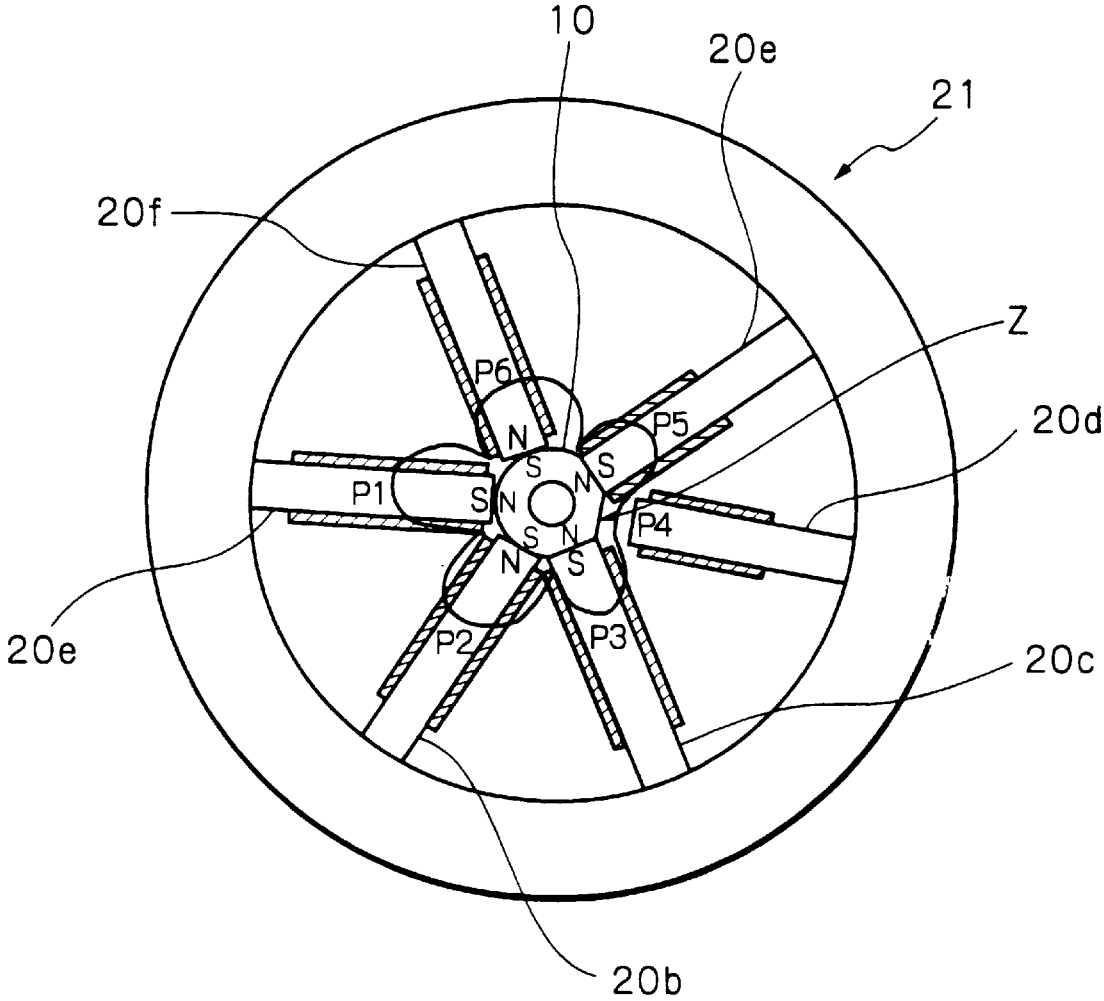
FIG. 7A is a section of a magnetizer.

FIG. 7A shows a magnetizer 21 including yokes or magnetizing members 20*a*–20*f* implemented by electromagnets. As shown in FIG. 7A, the molding 10 with the core 1 inserted therein is held by a holder, not shown, included in the magnetizer 21 such that the reference surface of the core 1 aligns with the orienting position X. Then, the molding 10 is magnetized by the magnetizer 21. While magnetic poles formed by the magnetization substantially coincide in position with the oriented positions, the scatter is smaller than when the core 1 is not subjected to demagnetization.

Figure 8:
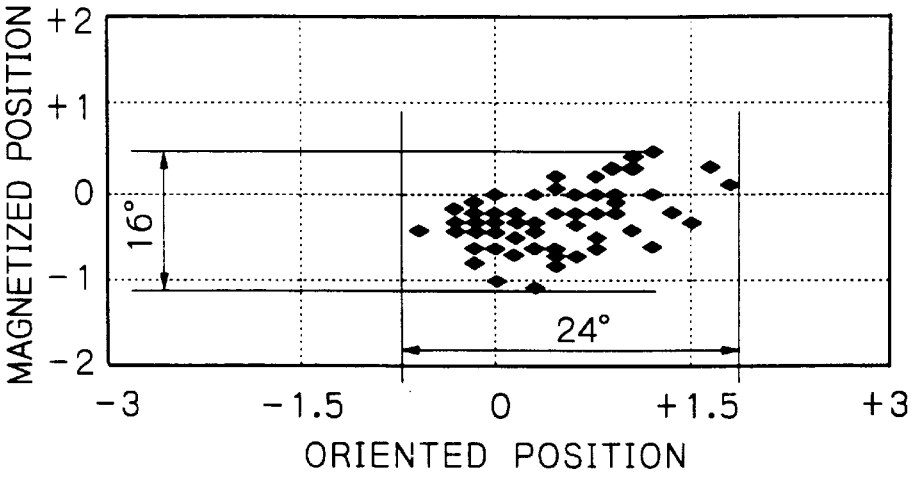
FIG. 8 is a graph showing a relation between the oriented and the magnetized position of the magnet member.

FIG. 8 shows a relation between the oriented position and the magnetized position of the molding 10. As FIG. 8 indicates, the magnetized position is scattered little, compared to the oriented position.

Figure 7B:
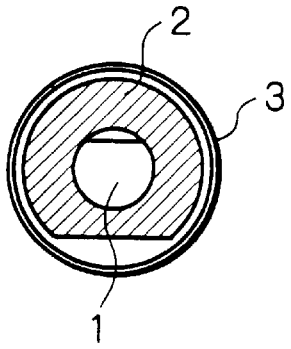
FIG. 7B is a section showing the developing roller with the magnetic member undergone magnetization.

Finally, as shown in FIG. 7B, the nonmagnetic sleeve 3, drive flange and driven flange are mounted to complete a product.

In the illustrative embodiment, pulse magnetic fields are applied to the molding 10 one by one. This can be done only if a current of about 3 kA is fed through about three turns of each yoke. It follows that even a developing roller having six or more poles on its circumference can be easily produced.

A magnetic circuit for providing the molding with the magnetic poles should be efficiently formed. For this purpose, as shown in FIG. 7A, the yokes of the magnetizer make nearby poles opposite in polarity to each other. For example, when the poles P1 and P2 of the molding 10 should be N pole and S pole, respectively, currents are fed to the yokes 20*a* and 20*b* respectively corresponding to the poles P1 and P2 such that the yokes 20*a* and 20*b* form the S pole and N pole, respectively. The magnetic pole (P4, FIG. 7A) forming a repulsive magnetic pole on the sleeve is exceptional. Specifically, the poles P3 and P5 adjoin the pole P4. The influence of magnetic fields formed by the yokes 20*c* and 20*e* corresponding to the poles P3 and P5, respectively may sometimes be so great, poles of the same polarity repulse each other and allow the desired magnetic characteristic to be set up without any current being fed to the yoke 20*d*. However, it may sometimes be necessary to feed a small current to the yoke 20*d*.

As stated above, in the illustrative embodiment, the core 1 is inserted into the through bore of the magnet member 2 with the reference surface Z of the magnet member 2 serving as a reference, and then the poles P1–P6 are positioned with the reference surface of the core 1 serving as a reference. It follows that if the developing roller is mounted to the developing device with the reference surface of the core 1 serving as a reference, then the poles P1–P6 of the magnet member 2 can be accurately positioned in the developing device.

The conventional procedure taught in, e.g., Japanese Patent Laid-Open Publication No. 63-289908 mentioned earlier has the following problems (1)–(5) because it causes a core to be inserted into a magnetized magnet member without being demagnetized.

(1) Because the scatter of the material directly influences the magnetic force, the scatter of the magnetic characteristic is aggravated by that of the material.

(2) It is impractical to implement a multipole structure having a sophisticated magnetic characteristic including a repulsive magnetic pole.

(3) The positions of magnetic poles are determined at the time of molding and therefore inaccurate.

(4) The magnetized magnet member gathers dust, metal powder and other impurities.

(5) The refuse of magnet derived from molding is apt to deposit.

Specifically, when the core is inserted into magnet member undergone orientation and magnetization, the characteristic of magnetic powder directly appears in the magnetic characteristic, aggravating the scatter of the magnetic force. While the magnetic characteristic may be stabilized if the magnetic field is controlled during orientation, such a scheme effects even the configuration of the molding and fails to stabilize it. Further, in the case of magnetic field orientation, magnetic fields are continuously applied and usually implemented by electromagnets using a DC current. However, to apply an electric field of 5,000 Oe to 10,000 Oe necessary for orientation, a current of 20 A to 50 A must be fed to a coil having more than 100 turns. The maximum number of poles available on the circumference of the developing roller with such a construction is only four to six due to the dimensions of the developing device. Moreover, when the core is inserted after magnetization effected during orientation, the positions of poles are unconditionally determined by the magnetized poles, the accuracy of the positioning flat surface, and the accuracy of insertion of the core. In addition, in the case of extrusion molding, the refuse of magnetized resin deposits on the molding and cannot be easily removed.

By contrast, in the illustrative embodiment, the reference surface Z of the molding is spaced from the sleeve by a greater distance than the portions adjoining it at the upstream side and downstream side in the direction of rotation of the sleeve, and the surface Z extends in the axial direction of the molding. This, coupled with the fact that the releasing pole P4 is coincident with the reference surface Z, a magnetic force releasing the developer from the surface of the sleeve can be readily formed on the surface of the sleeve.

Figure 2:
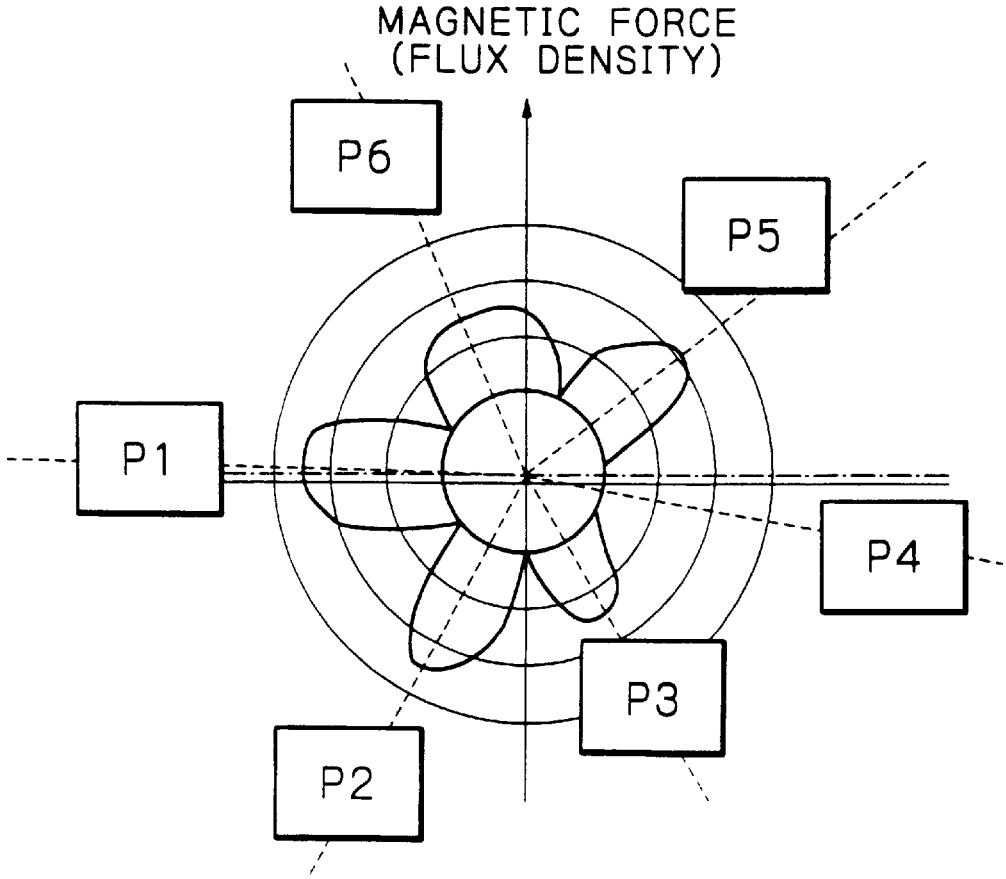
Fig. 2 PRIOR ART
FIG. 2 shows a magnetic characteristic particular to the conventional developing roller.
Figure 9:
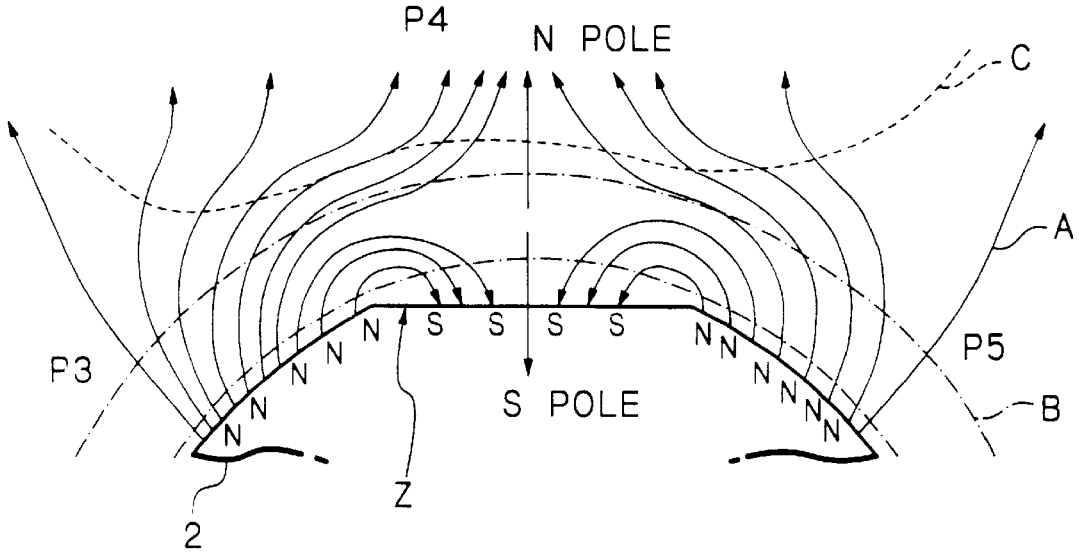
FIG. 9 shows the distribution of magnetic lines of force in the vicinity of the surface of the magnet member where a releasing magnetic pole is formed.

More specifically, as shown in FIG. 2, the characteristic of the developing roller must include the releasing pole P4 exerting a relatively weak magnetic force. The releasing pole P4 releases the developer from the surface of the sleeve 3, so that the force acting on the developer should preferably include a force directed away from the sleeve 3. In this case, the releasing pole P4 should preferably be a repulsive pole intervening between nearby strong poles on the sleeve 3. As shown in FIG. 9, the magnetic pole of the magnet member 2 for forming such a repulsive pole is opposite in polarity to the adjoining poles P3 and P5, but the former becomes identical with the latter and turns out a repulsive pole (in FIG. 9, N pole on the sleeve or S pole on the reference surface Z of the magnet member 2) when the gap is increased to a certain degree.

In light of the above, the gap between the magnet member 2 and the sleeve 3, as measured at the releasing pole P4, should preferably be greater than the gap at the adjoining poles P3 and P5. As for the other poles, the above gap should preferably be small enough to implement strong magnetic forces. If the axially extending reference surface Z is formed in a part of the circumference of the molding 10 for the positioning purpose, and if the releasing pole is magnetized on the surface Z, then the gap between the magnet member 2 and the sleeve 3 is greater at the surface Z than at the other portions. This facilitates the formation of the repulsive pole and thereby easily implements a developing roller capable of sharply releasing the developer.

There are also shown in FIG. 9 magnetic lines of force A, a surface B representative of the outer periphery of the sleeve 3, and a flux density distribution C.

Further, in the illustrative embodiment, after the core 1 undergone cooling and solidification has been inserted, magnetization is controlled by using the reference surface of the core 1 as a reference. Therefore, even if the angles between the reference surface of the core 1 and the positions of oriented poles differ from target angles, the positions of, e.g., the yokes or similar magnetizing members fixed relative to the reference surface of the core 1 serve to correct the positions of the poles at the time of magnetization and thereby enhance accuracy.

Moreover, the illustrative embodiment molds a magnetic material while applying magnetic fields thereto and then demagnetizes it. This prevents impurities including the refuse of magnet from magnetically depositing on the surface of the molding, while allowing the other deposits to be easily removed. The embodiment therefore realizes a magnet member having a desirable property.

In addition, although the magnetic characteristic of the magnet member 2 is apt to scatter due to the scatter of ferrite or similar raw material, the illustrative embodiment insures a stable magnetic characteristic because it effects magnetization later.

Figure 10A:
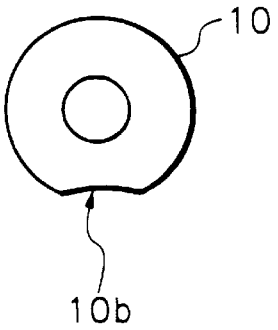
FIGS. 10A–10C each shows a particular modification of the illustrative embodiment.
Figure 10B:
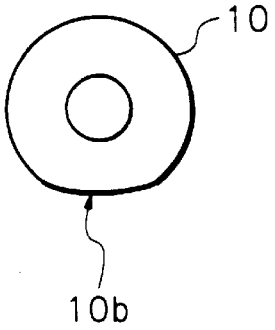
Figure 10C:
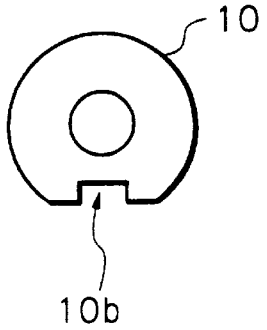

While the reference surface Z of the molding 10 has been shown as described as being flat, the surface Z may be modified in various ways so long as the distance between the molding 10 and the sleeve 10 is greater at the surface Z than at the portions adjoining it, and so long as the surface Z extends in the axial direction of the molding 10. For example, FIG. 10A shows a reference portion 10*b* slightly concave toward the axis of the molding 10. FIG. 10B shows a reference portion 10*b* slightly convex away from the axis of the molding 10. FIG. 10C shows a reference portion 10*c* in the form of a groove 10*b*. The flat reference surface Z is more desirable than such modifications when it comes to the accurate insertion of the core 1.

The flat reference surface Z should preferably have a width W greater than 4 mm inclusive. As for the flat reference surface Z, a scatter in positioning is considered to be about ±0.1 mm without regard to the width W of the surface Z. When the width W is 4 mm, a scatter of ±0.1 translates into an angular scatter of $\tan^{-1}(0.1/4)$, i.e., about 1.4°. Usually, a positional accuracy required of the magnetic poles of a developing roller for use in, e.g., a copier is less than ±2°, so that the above scatter of about ±1.4 is the allowable limit, taking account of axial twist. For example, should the width W be 3 mm, the scatter would increase to ±1.9°.

While the illustrative embodiment has concentrated on a magnet member included in the developing roller of a developing device, the present invention is similarly applicable to any desired member other than a developing roller.

A specific example of the illustrative embodiment will be described hereinafter.

Figure 11A:
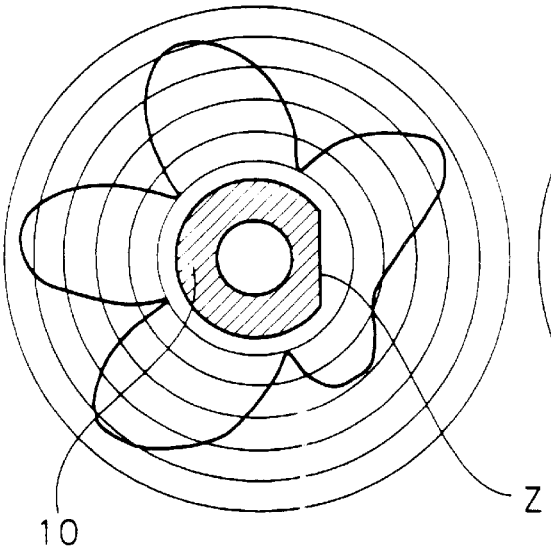
FIGS. 11A and 11B respectively show the magnetic characteristic of the molding before demagnetization and the magnetic characteristic after the same.
Figure 11B:
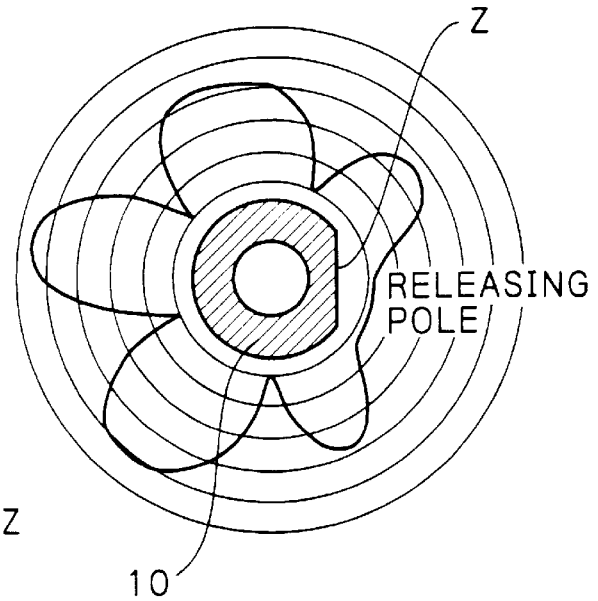

In the specific example, a molding having an outside diameter of 14 mm and an inside diameter of 6 mm and having a characteristic shown in FIG. 11A before demagnetization was produced. After the demagnetization of the molding, a metallic core was inserted into the molding. Then, magnetization was effected in such a manner as to set up a magnetic characteristics shown in FIG. 11B. The magnetic characteristic was measured on a sleeve having a diameter of 16 mm. For a magnet, use was made of EEA (Ethylene Ethyl Acrylate copolymer) containing 91 wt % of strontium ferrite. A die was so dimensioned as to form a 4 mm reference surface for positioning. The magnetic characteristic on the sleeve is shown in FIG. 11A; a repulsive pole is present at a position corresponding to a releasing pole. When 100 magnet members are produced by the above procedure, the scatter of the positions of poles was measured to be ±1.5°.

Figure 12:
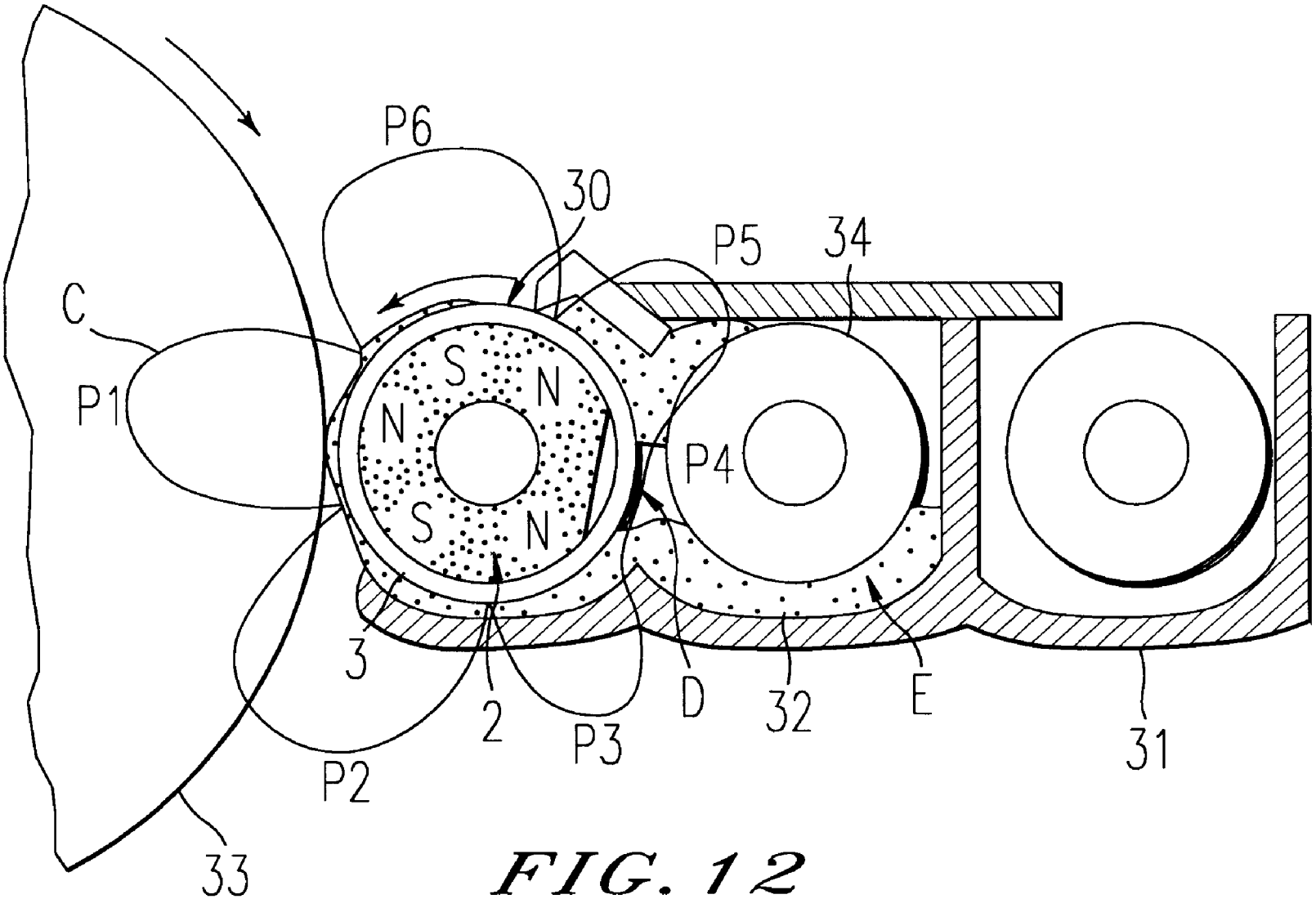
FIG. 12 shows a developing device using the magnet member of FIG. 11B.

The magnet members 2 of the example each was mounted to a developing device shown in FIG. 12 in order to determine an image characteristic. The developing device of FIG. 12 includes a developing roller 30 and a casing accommodating the developing roller 30. The sleeve 3 is rotatably supported by the casing 31 while the magnet member 2 is fixed in place within the sleeve 3 so as not to move relative to the casing 31.

The casing 31 is formed with an opening at its position corresponding to a main pole P1 facing a photoconductive element or image carrier 33. The main pole P1 transfers a developer from the developing roller 30 to the photoconductive element 33. Defined in the casing 31 are a releasing portion D where a part of a developer 32 is released from the surface of the sleeve 3 adjoining the releasing pole P4 of the magnet member 2, and a storing portion E storing the developer 32 and communicated to the releasing portion D. An agitator 34 for agitating the developer 32 is positioned in the storing portion E.

While the sleeve 3 is in rotation, the depositing pole or drawing pawl P5 of the magnet member 2 draws up the developer agitated by the agitator 34 and positioned above the releasing portion D and causes it to deposit on the sleeve 3. The conveying poles P2, P3 and P6 each conveys the developer deposited on the sleeve 3 due to the rotation of the sleeve 3. In FIG. 12, labeled C is a flux density distribution.

Experiments conducted with the developing device of FIG. 12 indicated that the releasing pole 2, depositing pole P5 and conveying poles P2, P3 and P6 of the magnet member 2 each played the respective role in a desirable manner. When latent images formed on the photoconductive element 31 were developed by the developing device, attractive toner images were transferred to papers.

In summary, it will be seen that the present invention provides a developing device and a developing roller therefor having various unprecedented advantages, as enumerated below.

(1) A flux density pattern to be formed on the surface of a sleeve by a releasing pole is provided with improved freedom. Therefore, a sophisticated magnetic characteristic including a repulsive pole for releasing a magnetic agent from the surface of the sleeve can be easily set up on the sleeve, compared to a case wherein the releasing pole is magnetized in a portion adjoining the surface of the sleeve, but other than a reference portion.

(2) After a magnet member has been mounted to the sleeve with the reference portion serving as a reference, the sleeve is mounted to a developing device. This allows the depositing pole, main pole and releasing pole of the magnet member to be accurately positioned within the developing device.

(3) The agent (developer) deposited on the sleeve by the depositing pole can be desirably conveyed by the magnetic force of the conveying pole to a region where the magnetic force of the main pole acts.

(4) The depositing pole can exert its magnetic force in a desirable manner.

(5) The agent (developer) moved away from the region where the force of the main pole acts can be desirably conveyed by the force of the conveying pole to a region where the force of the releasing pole acts.

(6) The agent (developer) can be surely released form the surface of the sleeve.

(7) Even when the magnet member is mounted to the developing device via a core, the poles of the magnet member can be accurately positioned within the device.

(8) The poles can be efficiently magnetized on the magnet member.

(9) The sleeve accommodating the magnet member and carrying the agent thereon is rotated within a casing, so that the agent can be partly transferred to a desired object. Moreover, the agent is released from the sleeve in a releasing portion adjoining the releasing pole and replaced with a magnetic agent existing in a storing portion communicated to the releasing portion. This, coupled with the fact that the replaced magnetic agent is deposited on the sleeve by the force of the depositing pole, insures the exchange of the agent on the sleeve and the agent in the storing portion.

(10) The magnet member can be produced by a simple procedure, compared to a case wherein the reference portion is formed after extrusion molding or injection molding.

(11) A magnetizer for magnetizing the various poles can be reduced in size.

(12) The various poles each can be surely magnetized at a preselected position of the magnet member.

Various modifications will become possible for those skilled in the art after receiving the teachings of the present disclosure without departing from the scope thereof.

What is claimed is:

1. A magnet member disposed in a rotatable sleeve and having a plurality of magnetic poles including a main pole for transferring developer and a releasing pole for generating on a surface of said sleeve a magnetic force for releasing a magnetic agent from said surface, a reference portion being formed on part of an outer periphery of said magnetic member and spaced from said surface of said sleeve by a distance greater than portions adjoining said reference portion at an upstream and a downstream side in a direction or rotation of said sleeve, and extending in a direction perpendicular to a direction of movement of said surface of said sleeve, said releasing pole being magnetized in said reference portion.

2. A magnetic member as claimed in claim 1, wherein a core is inserted in an axial bore extending throughout said sleeve and is positioned in said axial bore with said reference portion serving as a reference.

3. A method of producing a magnet member disposed in a rotatable sleeve and having a plurality of magnetic poles including a main pole for transferring developer and a releasing pole for generating on a surface of said sleeve a magnetic force for releasing a magnetic agent from said surface, a reference portion being formed on a part of an outer periphery of said magnetic member and spaced from said surface of said sleeve by a distance greater than portions adjoining said reference portion at an upstream and a downstream side in a direction of rotation of said sleeve, and extending in a direction perpendicular to a direction of movement of said surface of said sleeve, and said releasing pole being magnetized in said reference portion.

4. A magnet structure body comprising:

a rotatable sleeve; and a magnet member disposed in said sleeve and having a plurality of magnetic poles including a main pole for transferring developer and a releasing pole for generating on a surface of said sleeve a magnetic force for releasing a magnetic agent from said surface;

a reference portion being formed on a part of an outer periphery of said magnetic member and spaced from said surface of said sleeve by a distance greater than portions adjoining said reference portion at an upstream and a downstream side in a direction of rotation of said sleeve, and extending in a direction perpendicular to a direction of movement of said surface of said sleeve, said releasing pole being magnetized in said reference portion.

5. A magnetizer for magnetizing a magnet member disposed in a rotatable sleeve and having a plurality of magnetic poles including a main pole for transferring developer and a releasing pole for generating on a surface of said sleeve a magnetic force for releasing a magnetic agent from said surface, a reference portion being formed on a part of an outer periphery of said magnetic member and spaced from said surface of said sleeve by a distance greater than portions adjoining said reference portion at an upstream and a downstream side in a direction of rotation of said sleeve, and extending in a direction perpendicular to a direction of movement of said surface of said sleeve, said releasing pole being magnetized in said reference portion;

said magnetizer comprising:

a holding member for positioning and holding said magnet member at a positioning section by using said reference portion of said magnet member as a reference; and a plurality of magnetizing members respectively positioned at positions for magnetizing said plurality of magnetic poles with said positioning section serving as a reference.

* * * * *